US008418510B2

(12) United States Patent
Oak et al.

(10) Patent No.: US 8,418,510 B2
(45) Date of Patent: Apr. 16, 2013

(54) WASHING MACHINE

(75) Inventors: Seong Min Oak, Hwaseong-si (KR); Tae Jin Park, Gimhae-si (KR); Hyun Sook Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 652 days.

(21) Appl. No.: 12/423,982

(22) Filed: Apr. 15, 2009

(65) Prior Publication Data

US 2010/0263410 A1 Oct. 21, 2010

(51) Int. Cl.
*D06F 17/12* (2006.01)

(52) U.S. Cl.
USPC ..... 68/5 C; 68/183

(58) Field of Classification Search ..... 68/12.02, 68/12.18, 17 R, 17 A, 58, 183, 5 C
See application file for complete search history.

(56) References Cited

U.S. PATENT DOCUMENTS 5,295,373 A * 3/1994 Lim et al. ..... 68/12.05
2004/0025544 A1 * 2/2004 Kim et al. ..... 68/3 R
2008/0250823 A1 * 10/2008 Oak et al. ..... 68/5 C

FOREIGN PATENT DOCUMENTS

KR 2000-0045020 * 7/2000

* cited by examiner

*Primary Examiner* — Saeed T Chaudhry
(74) *Attorney, Agent, or Firm* — Staas & Halsey LLP

(57) ABSTRACT

Disclosed herein is a washing machine that performs washing using bubbles. The washing machine may include an air bubble unit to generate air bubbles in detergent water using external air naturally introduced thereinto by pressure difference caused when the detergent water passes therethrough, a water tub having an introduction port to allow the detergent water containing the air bubbles to be introduced thereinto, and a washing tub rotatably provided in the water tub, the washing tub having a plurality of through-holes having a size less than the introduction port such that the air bubbles rise to a surface of the detergent water contained in the water tub.

31 Claims, 9 Drawing Sheets

WASHING MACHINE

BACKGROUND

1. Field

Embodiments of the present invention relate to a washing machine that performs washing using bubbles.

2. Description of the Related Art

Generally, a washing machine washes laundry by rotating a cylindrical washing tub containing the laundry and detergent water. The washing machine includes a water tub to contain detergent water, a washing tub rotatably mounted in the water tub, the washing tub having through-holes for spin-drying formed in the circumference thereof, and a drive unit to drive the washing tub. Also, the washing machine may include a water supply unit to supply detergent water into the water tub and a drainage unit to drain water from the water tub.

When a user puts laundry into the washing tub, selects a washing course, and operates the washing machine, an amount of detergent water is decided based on the weight (load) of the laundry, amounts of water and detergent corresponding to the decided amount of detergent water are supplied into the water tub, and the laundry is washed by friction between laundry articles or dropping of the laundry through rotation of the washing tub.

In such a conventional washing machine, however, the water tub is filled with water sufficient for laundry to be soaked in detergent water, resulting in high water consumption. Also, a large amount of detergent is used to wash the laundry.

Korean Patent Application Publication No. 2000-0045020 discloses a washing machine having an air bubble unit.

The air bubble unit includes a circulation pipe connected to the bottom of a water tub, in which a washing tub is rotatably mounted, to circulate water, a pump to pump out the water from the water tub through the circulation pipe to circulate water, a venturi tube connected to one end of the circulation pipe, the venturi tube having a small diameter tube disposed in the middle of a large diameter tube to decrease a channel section, and an air bubble generator connected to the small diameter tube of the venturi tube to supply air.

In the disclosed washing machine, however, washing is performed while laundry is soaked in detergent water, resulting in high water and detergent consumption.

Also, air bubbles may collide with the laundry soaked in the detergent water to improve washing efficiency. However, the improved washing efficiency is too low to satisfy consumers.

For laundry, such as wool or silk, requiring delicate washing, the laundry may be damaged by friction between the laundry and the water and between laundry articles caused by rotation of the washing tub.

SUMMARY

Therefore, it is an aspect of an embodiment of the present invention to provide a washing machine that performs washing with a small amount of water.

It is another aspect of an embodiment of the present invention to provide a washing machine having high washing efficiency.

It is a further aspect of an embodiment of the present invention to provide a washing machine that minimizes damage to laundry during washing.

Additional aspects of an embodiment of the invention will be set forth in part in the description which follows and, in part, will be obvious from the description, or may be learned by practice of the invention.

In accordance with one aspect of an embodiment of the present invention, a washing machine includes an air bubble unit to generate air bubbles in detergent water using external air naturally introduced thereinto by pressure difference caused when the detergent water passes therethrough, a water tub having an introduction port to allow the detergent water containing the air bubbles to be introduced thereinto, and a washing tub rotatably provided in the water tub, the washing tub having a plurality of through-holes having a size less than the introduction port such that the air bubbles rise to a surface of the detergent water contained in the water tub.

The air bubble unit may include a nozzle having a gradually decreasing inner diameter, an air bubble generator extending from the nozzle, the air bubble generator having an increasing inner diameter, and an air suction hole communicating with the air bubble generator to guide external air to the air bubble generator.

The inner diameter of the air bubble generator may suddenly increase at the nozzle.

The air bubble unit may further include a nozzle guide extending to an inlet of the nozzle to guide detergent water to the nozzle, and the nozzle guide may have an inner diameter greater than the air bubble generator.

The air bubble generator may allow the air introduced through the air suction hole to be turbulently mixed with the detergent water.

The air bubble unit may further include a diffuser extending from the air bubble generator, the diffuser having a gradually increasing diameter.

The air bubble unit may have a length of about 60 to about 70 mm, and the nozzle guide may have an inner diameter of about 20 to about 27 mm.

The air bubble generator may have an inner diameter of about 11 to about 15 mm, and the air suction hole may have a diameter of about 4 to about 15 mm.

The washing machine may further include an air guide pipe having one end communicating with the air suction hole and the other end located at a position higher than a level of the detergent water in the water tub to prevent the detergent in the water tub from being discharged to the air suction hole.

The inner diameter of the nozzle guide may be at least two times greater than the nozzle.

The air bubble unit may be configured to supply air bubbles to the water tub such that, when the air bubbles rise to an interior of the washing tub through the through-holes of the washing tub, the air bubbles increase in size as they travel up to the surface of the detergent water, resulting in bubbles ranging in size between about 3 mm and about 15 mm at or near the surface of the detergent water.

The air suction hole may be located within about 6 mm from an air suction hole-side end of the nozzle.

The washing machine may further include a drainage port formed at a bottom of the water tub and a circulation pump to discharge the detergent water from the water tub to the drainage port to forcibly move the detergent water to the air bubble unit.

The drainage port may be spaced apart from the introduction port by a predetermined distance such that air bubbles introduced from the introduction port are not discharged to the drainage port.

The drainage port may be spaced apart from the introduction port by about 140 mm.

The washing machine may further include a return hose to guide water from the circulation pump to the air bubble unit.

The air bubble unit may be directly connected to a lower side of the water tub.

The introduction port may be opened such that the detergent water containing the air bubbles is introduced in substantially the same direction as an installation plane of a machine housing to join the detergent in the washing tub.

The introduction port may be located at a front of the water tub adjacent to a bottom of the water tub, and the introduction port may include a passageway, having a predetermined length, to guide a flow direction of the detergent water containing the air bubbles.

The air bubble unit may be directly connected to the introduction port substantially in parallel to an axial direction of the water tub.

The washing machine may further include a sealing member provided between the air bubble unit and the introduction port to prevent leakage of detergent water.

The air bubble unit may be coupled to the water tub by screws, and the washing machine may further include a fixing guide supported at the water tub to prevent the air bubble unit from vibrating.

The washing machine may further include a pad provided at the water tub to smoothly introduce bubbles formed between an inner circumference of the water tub and an outer circumference of the washing tub into the washing tub.

The pad may be formed of rubber, and may be attached to the inner circumference of the water tub.

The washing tub may include a plurality of through-holes provided at a circumference thereof and a plurality of rear through-holes provided at a rear thereof, and bubbles formed between the water tub and the washing tub may be introduced into the washing tub through the through-holes and the rear through-holes.

The rear through-holes may have a diameter greater than the through-holes but less than the introduction port.

The washing machine may further include a drainage pump to drain the detergent water from the water tub to an outside, and a pump housing having the circulation pump and the drainage pump mounted therein may be configured in one unified body.

The washing machine may include a drum type washing machine to load laundry through a front thereof.

In accordance with another aspect of an embodiment of the present invention, a washing machine includes a machine housing, a water tub provided in the machine housing, a washing tub provided in the water tub to receive laundry, a detergent supply unit to supply detergent, a water supply unit to supply water mixed with the detergent in the detergent supply unit, i.e., detergent water, to the water tub, an air bubble unit to generate air bubbles in the detergent water when the detergent water passes therethrough, and a controller to control an amount of water supplied from the water supply unit to a predetermined level not to soak the laundry in the detergent water such that the laundry is surrounded by bubbles formed at a surface of the detergent water by the air bubbles.

The air bubble unit may generate the air bubbles in the detergent water using external air naturally introduced thereinto by pressure difference caused when the detergent water passes therethrough.

The controller may control an amount of water supplied from the water supply unit such that the laundry is wetted.

The air bubble unit may be coupled to a lower side of the water tub such that the detergent water discharged from the air bubble unit is introduced into a lower part of the water tub in a frontward-and-rearward direction.

The air bubble unit may be coupled to a lower side of the water tub such that the detergent water containing the air bubbles is introduced into a lower part of the water tub in a lateral direction.

In accordance with another aspect of an embodiment of the present invention, a washing machine includes a water tub to contain detergent water having detergent dissolved therein, a washing tub rotatably provided in the water tub to receive laundry, a circulation pump to discharge the detergent water from the water tub and return the discharged detergent water to the water tub, an air bubble unit to generate air bubbles in the detergent water using external air naturally introduced thereinto by pressure difference caused when the detergent water passes therethrough by the circulation pump, and a controller to control the circulation pump to be driven for a predetermined time such that bubbles formed by the air bubbles rising to a surface of the detergent water stick to the laundry.

The washing machine may further include a drainage pump to drain water from the water tub.

The air bubble unit may be directly coupled to the water tub outside the water tub.

The washing machine may further include a level detection unit to detect a level of the detergent water in the water tub, and the air bubble unit may be located lower than the level detection unit.

In accordance with a further aspect of an embodiment of the present invention, a washing machine includes a water tub to contain detergent water having detergent dissolved therein, an air bubble unit to generate air bubbles in detergent water when the detergent water passes therethrough and to inject the detergent water containing the air bubbles into the detergent water in the water tub in a horizontal direction, and a washing tub rotatably provided in the water tub, the washing tub having a plurality of through-holes such that the air bubbles rise to a surface of the detergent water contained in the water tub.

The air bubble unit may be horizontally located at a level corresponding to the detergent water in the water tub.

According to an embodiment, a washing machine includes a housing, an outer tub provided in the housing to contain washing water, an inner tub provided in the outer tub for receiving laundry, a pump to cause the washing water drawn from the outer tub to be pumped back into the outer tub, and a mixing chamber provided between the pump and the outer tub to mix air into water being pumped back into the outer tub via the pump, the mixing chamber including a water passageway having at least two different effective inner diameters at different location points thereof and an air inlet in communication with the water passageway for receiving air from an exterior of the mixing chamber for mixing with the water therein, and the air inlet of the mixing chamber is provided at a location point downstream of the narrowest point of the water passageway. The air inlet of the mixing chamber may be provided within 6 mm of the narrowest point of the water passageway. An effective inner diameter at the widest point of the water passageway may be at least two times greater than an effective inner diameter of the narrowest point of the water passageway, whereby the air mixed with the water in the mixing chamber is converted into bubbles for washing.

According to an embodiment, a washing machine includes a housing, an outer tub provided in the housing to contain washing water, an inner tub provided in the outer tub for receiving laundry, the inner tub including a plurality of holes formed therein to allow water to pass therethrough, a pump to cause the washing water drawn from the outer tub to be pumped back into the outer tub, and a mixing chamber provided between the pump and the outer tub to mix air into water being pumped back into the outer tub via the pump, whereby the air mixed with the water in the mixing chamber is converted into bubbles for washing. The mixing chamber may include an outlet mounted to a lower portion of the outer tub such that water flows directly from the outlet of the mixing chamber into the interior of the outer tub. The mixing chamber may be mounted to the outer tub such that the air mixed water being pumped into the outer tub flows in a substantially horizontal direction. The mixing chamber may include a water passageway defined by a first section and a second section and an air inlet for receiving air from an exterior of the mixing chamber, and the second section has an effective inner diameter that is smaller than an effective inner diameter of the first section. The air inlet of the mixing chamber may be provided at the second section thereof. The effective inner diameter of the first section may be at least 1.3 times greater than the effective inner diameter of the second section. The effective inner diameter of the first section of the mixing chamber may be between 20 mm and 27 mm. The effective inner diameter of the second section of the mixing chamber may be between 11 mm and 15 mm. The effective inner diameter of the air inlet of the mixing chamber may be between 4 mm and 15 mm. The air inlet may be coupled to receive air via an air tubing having an air entry positioned at an elevation that is higher than a water level corresponding to a surface of the water contained in the outer tub, when the washing machine is in operation. According to an embodiment, in use, washing water rapidly passes through the water passageway of the mixing chamber causing air to be inhaled via the air inlet, causing washing water to be mixed with air flowing through the air inlet, forming air bubbles in the washing water existing the mixing chamber.

According to an embodiment, the mixing chamber may include a first cylindrical section integrally formed with a second cylindrical section. The first section may have a reduced diameter region adjacent to the second section so as to increase velocity of water flow as water enters the second section, and the effective inner diameter of the reduced diameter region may gradually decrease in size until the reduced diameter region meets the second section, from a first diameter to a second diameter. The first diameter of the reduced diameter region may be at least two times greater than the second diameter of the reduced diameter region. A portion of the second section located adjacent to the reduced diameter region of the first section may be configured to generate turbulence as the water enter the second section from the reduced diameter region of the first section. A portion of the second section located adjacent to the reduced diameter region of the first section may be configured such that the effective inner diameters of the reduced diameter region and the second section increase in a single step-wise manner.

According to an embodiment, the mixing chamber may be positioned with respect to the outer tub such that, a vertical distance between the mixing chamber and a water level corresponding to a surface of the water contained in the outer tub, when the washing machine is in operation, is less than 20 cm. The mixing chamber may be positioned with respect to the outer tub such that, a vertical distance between the mixing chamber and a lower portion of the outer tub is less than 7 cm.

According to an embodiment, the air bubble unit may be configured to supply tiny air bubbles to the outer tub such that when the air bubbles rise to the interior of the inner tub through the holes formed therein, the air bubbles increase in size as they travel up to the water surface, resulting in bubbles ranging in size between 3 mm to 15 mm at or near the water surface.

According to an embodiment, at least one padding member may be disposed between the outer tub and the inner tub to reduce the size of region in which bubbles may reside between the outer tub and the inner tub.

According to an embodiment, at least one spacing member disposed between the outer tub and the inner tub to reduce the size of region in which bubbles may reside between the outer tub and the inner tub.

According to an embodiment, the washing machine may be a front-loading type, and the inner tub may be rotatably mounted in the tub.

According to an embodiment, the washing machine may be a top-loading type, and the inner tub may include a vertically-mounted basket provided in the tub, with a propeller-like agitator provided in the center of the basket.

According to an embodiment, the washing machine may further include a water and detergent supply unit configured to supply washing water including water and detergent to inside the outer tub and a drain unit having a pump to discharge the washing water contained in the outer tub to the outside.

According to an embodiment, a washing machine includes a water tub, a washing tub rotatably provided in the water tub to receive laundry, a water supply unit to supply water mixed with detergent to a level for the laundry placed in the washing tub not to be soaked or to be partially soaked, to make detergent water, and an air bubble unit to generate air bubbles in the water, and the air bubbles generated by the air bubble unit may be converted into bubbles for washing, and the bubbles may be supplied to a portion of the laundry not soaked in the detergent water.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
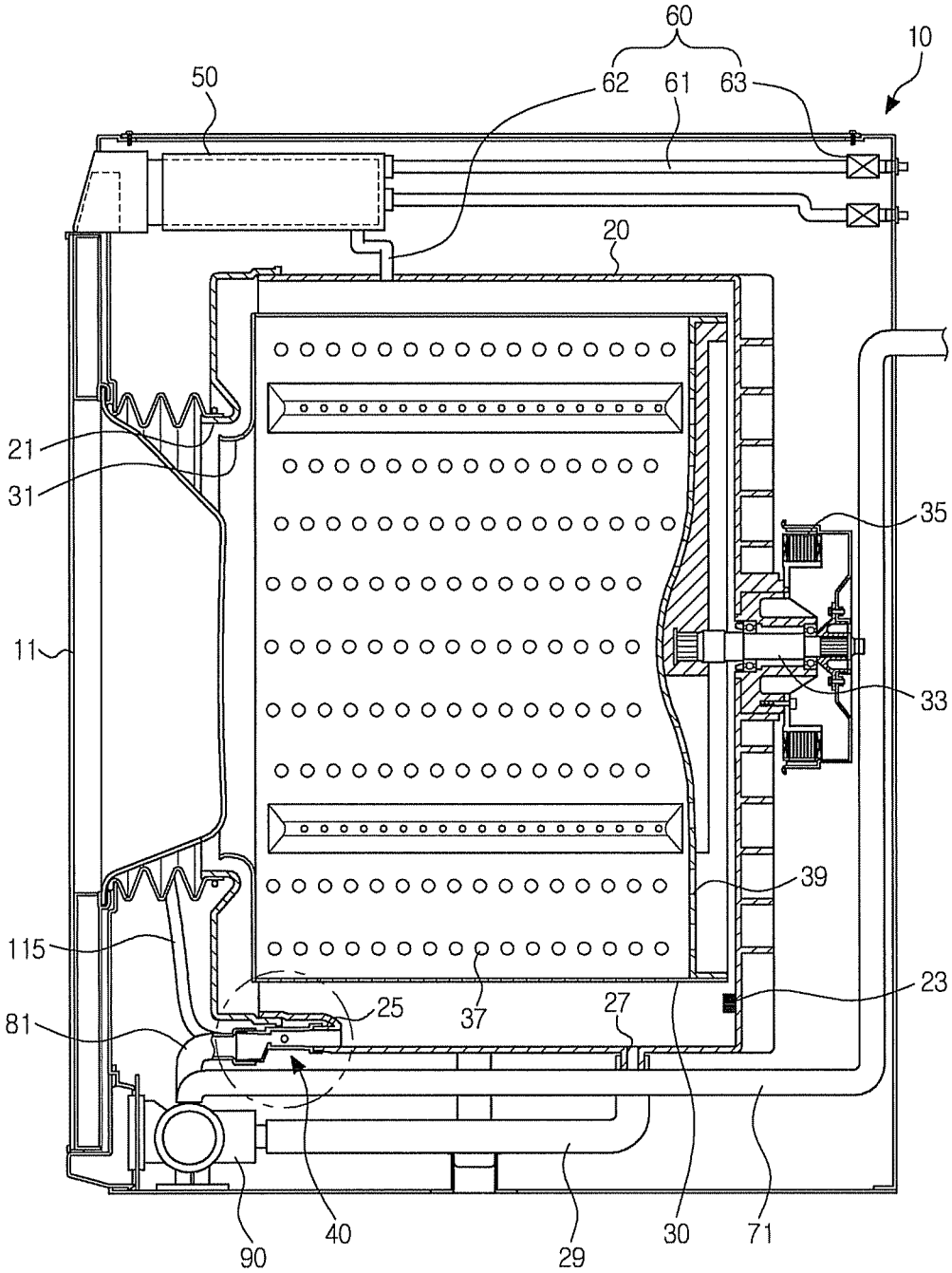
FIG. 1 is a sectional view schematically illustrating a washing machine according to an embodiment of the present invention.

Reference will now be made in detail to the embodiments of the present invention, examples of which are illustrated in the accompanying drawings, wherein like reference numerals refer to the like elements throughout.

Figure 2:
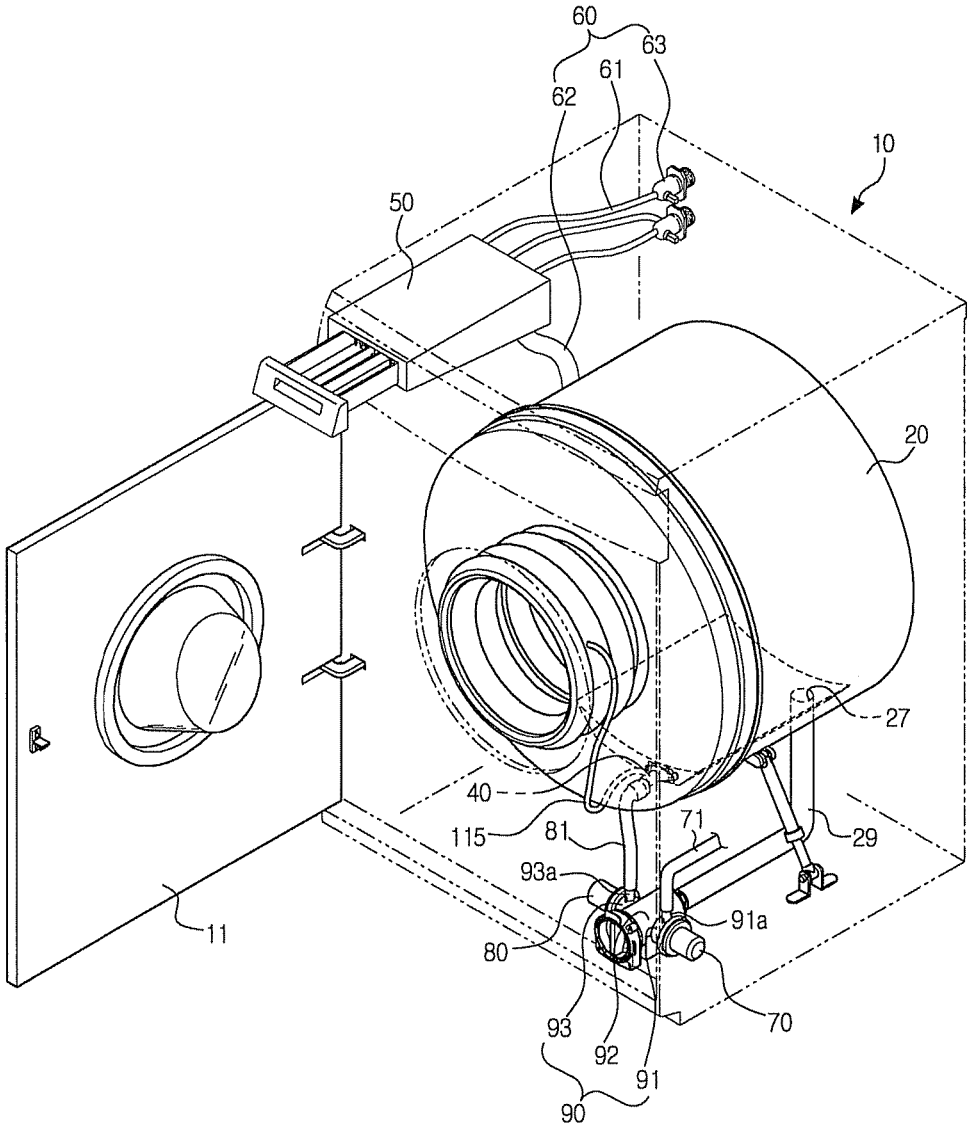
FIG. 2 is a perspective view of the washing machine according to the embodiment of the present invention.

FIG. 1 is a sectional view schematically illustrating a washing machine according to an embodiment of the present invention, and FIG. 2 is a perspective view of the washing machine according to the embodiment of the present invention.

As shown in FIG. 1, the washing machine includes a drum-type water tub 20 mounted in a machine housing 10 to contain detergent water, an air bubble unit 40 (also referred to herein as "mixing chamber") to generate air bubbles in the detergent water, and a washing tub 30 rotatably mounted in the water tub 20 to wash laundry using bubbles formed at the surface of the detergent water by the air bubbles.

The air bubbles are discharged from the air bubble unit, and expand in the detergent water. The bubbles are formed by air bubbles forming and swelling at the surface of the detergent water by surfactant of detergent around the air bubbles.

At the fronts of the water tub 20 and the washing tub 30 are formed openings 21 and 31, respectively, through which a user removes laundry from the washing tub 30 in front of the machine housing 10. At the front of the machine housing 10 is mounted a door 11 to open and close the opening 21 of the water tub 20.

Above the water tub 20 are mounted a detergent supply unit 50 to supply detergent and a water supply unit 60 to supply water mixed with detergent in the detergent supply unit 50, i.e., detergent water, to the water tub 20.

The detergent supply unit 50 has a plurality of partitioned spaces. The detergent supply unit 50 is mounted at the front side of the machine housing 10 such that a user may easily place detergent and rinse in the respective partitioned spaces.

The water supply unit 60 includes a first water supply pipe 61 to supply water from an external water supply source to the detergent supply unit 50, a second water supply pipe 62 to supply water mixed with detergent in the detergent supply unit 50, i.e., detergent water, to the water tub 20, and a water supply valve 63 mounted on the first water supply pipe 61 to control the supply of water by opening and closing the first water supply pipe 61.

Consequently, water supplied from the outside through the first water supply pipe 61 is mixed with detergent in the detergent supply unit 50 into detergent water, which is introduced into the water tub 20 through the second water supply pipe 62.

Outside the rear of the water tub 20 is mounted a drive unit, such as a motor 35, to rotate a rotary shaft 33 connected to the washing tub 30.

Inside the lower side of the rear of the water tub 20 may be mounted a level detection unit 23 to detect the level of detergent water supplied into the water tub 20.

The level detection unit 23 may be mounted above the air bubble unit 40. The level detection unit 23 detects a predetermined level at which the detergent water is not introduced into the washing tub 30 in which the laundry is placed, or a predetermined level at which the laundry is wetted while not being soaked in the detergent water, to detect a level to wash the laundry using bubbles. When the detergent supplied during washing reaches the predetermined level, the water supply valve 63 is closed to stop water supply such that the detergent water is not introduced into the washing tub 30.

At the lower side of the front of the water tub 20 is formed an introduction port 25 to introduce the detergent water containing air bubbles generated by the air bubble unit 40 into the water tub 20. At the bottom of the water tub 20 is formed a drainage port 27 to drain the water from the water tub 20 to the outside.

The introduction port 25 has a sectional area equal to or greater than that of an air bubble generator 103 of the air bubble unit 40, which will be described later, to smoothly guide air bubbles generated by the air bubble unit 40 into the water tub 20.

In this embodiment, the introduction port 25 is formed in the sectional shape of an ellipse having a horizontal length greater than a vertical length due to its positional restriction at the lower side of the front of the water tub 20. The introduction port 25 may have a vertical length of about 15 mm to about 25 mm and a horizontal length of about 30 mm to about 40 mm. Alternatively, the introduction port 25 may be formed in various sectional shapes, such as a circle or polygon.

In the circumference and rear of the washing tub 30, rotatably mounted in the water tub 20, are formed pluralities of through-holes 37 and rear through-holes 39, respectively.

The through-holes 37 allow water to flow between the water tub 20 and the washing tub 30. The through-holes 37 have a size sufficient to prevent damage to laundry during spin-drying. The through-holes 37 may have a size of about 2.0 to 3.0 mm. In this embodiment, the through-holes 37 have a size of about 2.4 mm.

The rear through-holes 39 have a size greater than that of the through-holes 37 to easily achieve water flow between the water tub 20 and the washing tub 30. The rear through-holes 39 may have a size of about 5.0 to 7.0 mm. In this embodiment, the rear through-holes 39 have a size of about 6.0 mm.

With the supply of detergent water into the water tub 20, the detergent water is introduced into the washing tub 30 through the through-holes 37 and the rear through-holes 39.

Below the water tub 20 are mounted a drainage pump 70 to drain water from the water tub 20 and a circulation pump 80 to return the detergent water drained out of the water tub 20 to the water tub 20, as shown in FIG. 2. In front of the water tub 20, below the water tub 20, is mounted a pump casing 90.

The pump casing 90 includes a filter housing 92 in which a drainage filter (not shown) to filtering foreign matter from the detergent water is mounted and a pair of pump housings 91 and 93 disposed at opposite sides of the filter housing 92. The drainage pump 70 and the circulation pump 80 are mounted in the pump housing 91 and 93, respectively.

Between the pump casing 90 and the drainage port 27 is connected a connection hose 29 to guide water discharged from the drainage port 27 to the filter housing 92 of the pump casing 90.

The pump housing 91, in which the drainage pump 70 is mounted, will be referred to as a first pump housing. The pump housing 93, in which the circulation pump 80 is mounted, will be referred to as a second pump housing.

The first and second pump housings 91 and 93 have discharge ports 91*a* and 93*a* formed in the radial directions thereof, respectively. A drainage hose 71 is connected to the discharge port 91*a* of the first pump housing 91. A return hose 81 is connected to the discharge port 93*a* of the second pump housing 93.

When the drainage pump 70 is driven, therefore, water from the water tub 20 is introduced into the pump casing 90, where the water is filtered by the drainage filter (not shown). Subsequently, the water is discharged out of the machine housing 10 through the drainage hose 71. When the circulation pump 80 is driven, water from the water tub 20 is introduced into the pump casing 90, where the water is filtered by the drainage filter. Subsequently, the water is returned to the water tub 20 through the drainage hose 81.

The air bubble unit 40 to generate air bubbles in detergent water is mounted on the return hose 81.

Figure 3:
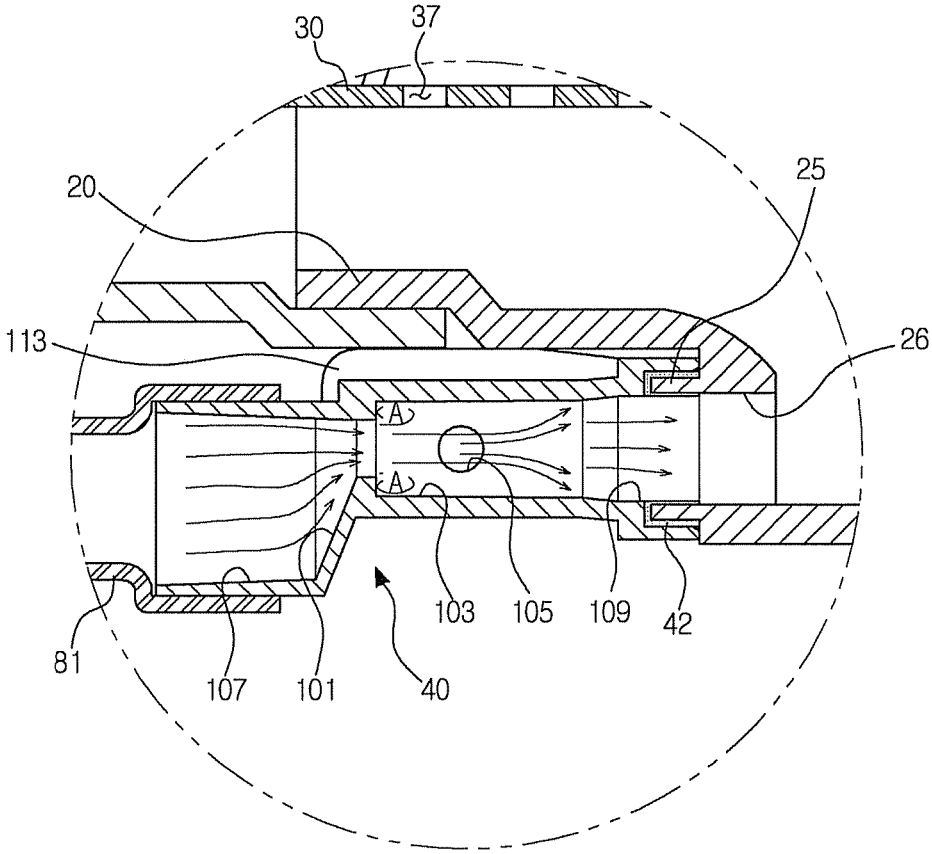
FIG. 3 is an enlarged view illustrating part A of FIG. 1.
Figure 4:
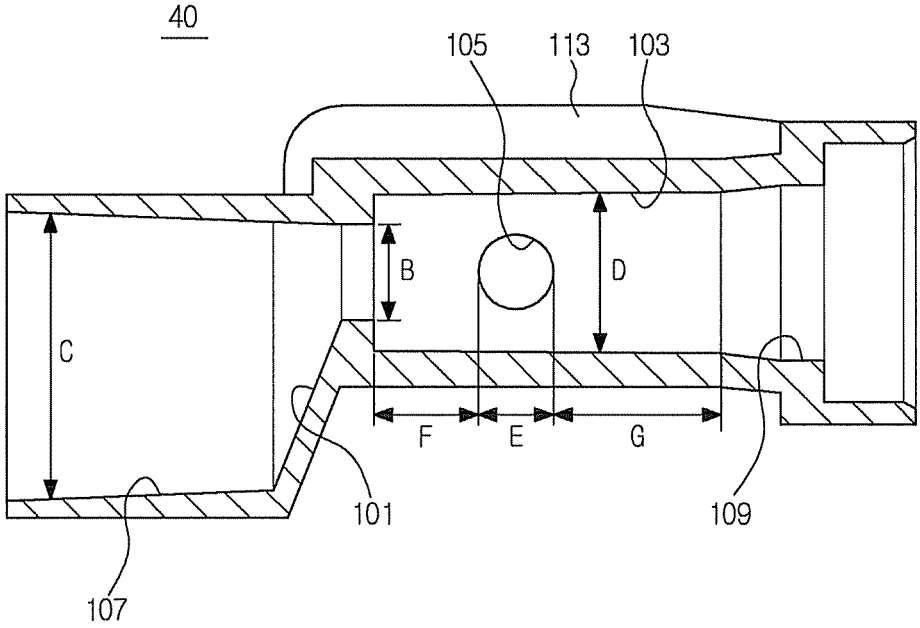
FIG. 4 is a sectional view illustrating an air bubble unit included in the washing machine according to the embodiment of the present invention.
Figure 5:
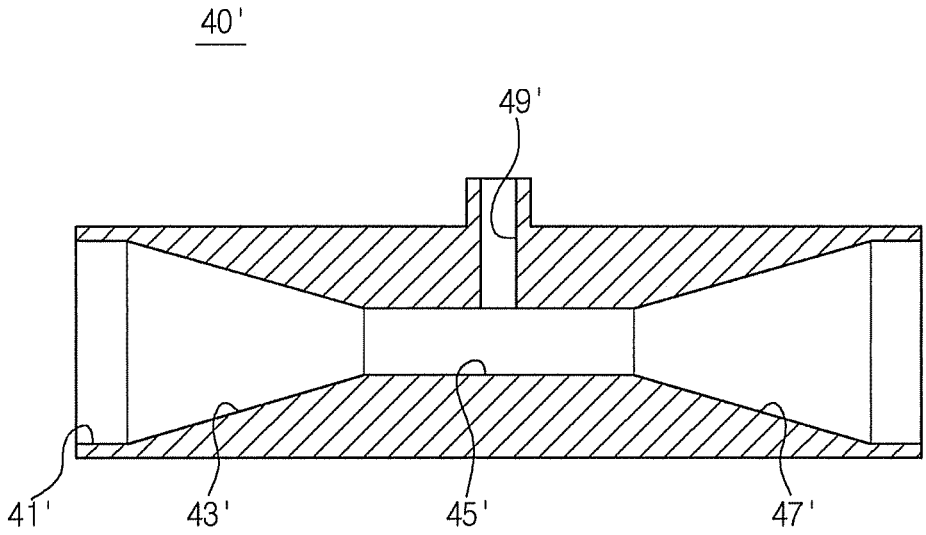
FIG. 5 is a sectional view illustrating a modification of the air bubble unit included in the washing machine according to the embodiment of the present invention.
Figure 6:
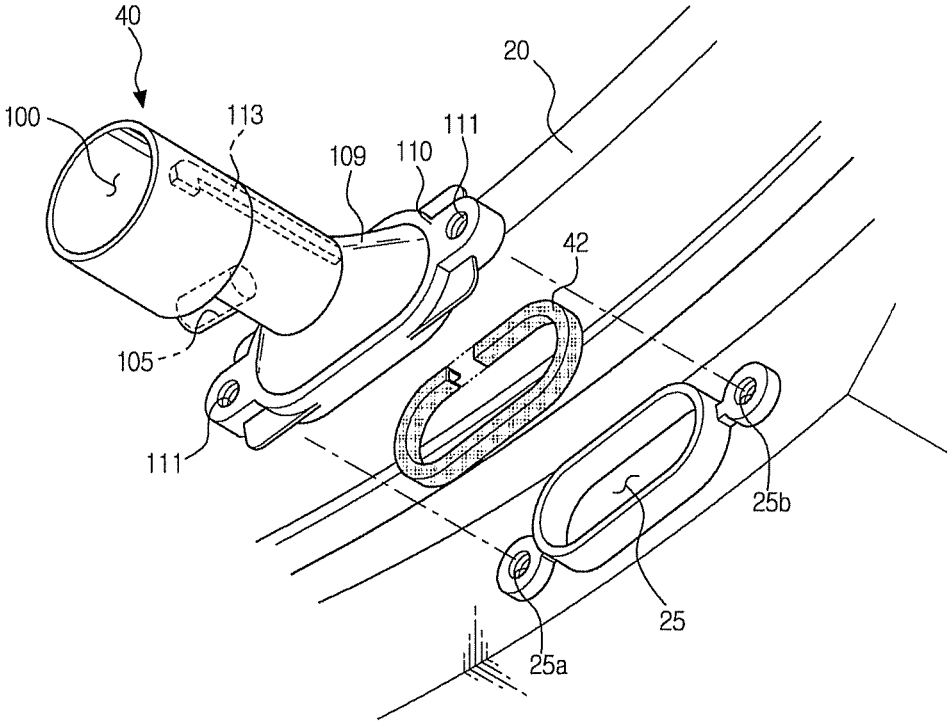
FIG. 6 is a view illustrating a process of assembling the air bubble unit included in the washing machine according to the embodiment of the present invention.

FIG. 3 is an enlarged view illustrating part A of FIG. 1, FIG. 4 is a sectional view illustrating an air bubble unit included in the washing machine according to the embodiment of the present invention, FIG. 5 is a sectional view illustrating a modification of the air bubble unit included in the washing machine according to the embodiment of the present invention, and FIG. 6 is a view illustrating a process of assembling the air bubble unit included in the washing machine according to the embodiment of the present invention.

As shown in FIGS. 3, 4 and 6, the air bubble unit 40 (also referred to herein as "mixing chamber") generates air bubbles in detergent water using external air naturally introduced into the air bubble unit 40 by pressure difference caused when the detergent water passes through the air bubble unit 40. The air bubble unit 40 is provided at the inside thereof with a passageway 100 to allow the return hose 81 to communicate with the water tub 20. The air bubble unit 40 is provided at the outside thereof with a fixer 110 to fix the air bubble unit 40 to the water tub 20.

The passageway 100 includes a nozzle 101 having a gradually decreasing inner diameter, the air bubble generator 103 having an inner diameter greater than the minimum inner diameter of the nozzle 101, and an air suction hole 105 communicating with the air bubble generator 103 to guide air to the air bubble generator 103.

The nozzle 101 is configured to have a gradually decreasing inner diameter. A nozzle guide 107 to guide detergent water to the nozzle 101 extends to the inlet of the nozzle 101 such that the nozzle guide 107 has approximately the same inner diameter.

Between the nozzle 101 and the air bubble generator 103 is formed a step.

At one end of the air bubble generator 103 is provided a diffuser 109 enlarged to have a section corresponding to that of the introduction port 25 of the water tub 20. The diffuser 109 is formed in the sectional shape of an ellipse having a horizontal length greater than a vertical length to smoothly supply detergent water containing a large amount of air bubbles into the water tub 20.

A flow guide 26 to uniformly maintain the flow direction of the detergent water discharged from the air bubble unit 40 extends from the introduction port 25 into the water tub 20 by a predetermined length.

In this embodiment, the diffuser 109 is integrally formed with the air bubble unit 40. Alternatively, the introduction port 25 may be modified to have a section corresponding to that of the air bubble generator 103, and the flow guide may be gradually increased in section to function as the diffuser. Also, the diffuser may be formed of a separate member, which may be disposed between the air bubble unit and the introduction port.

Detergent water flows in the air bubble unit 40 as follows. The detergent water, having passed through the nozzle guide 107, flows to the nozzle 101. Since the inner diameter of the nozzle 101 gradually decreases, the flow speed of the detergent water gradually increases while the pressure of the detergent water gradually decreases. After passing through the nozzle 101, the detergent water flows to the air bubble generator 103. Since the air bubble generator 103 is increased in section to have a step between the air bubble generator 103 and the nozzle 101, the inner diameter of the air bubble generator 103 suddenly increases.

The detergent water introduced into the air bubble generator 103 flows in whirls at a predetermined section. As shown in FIG. 3, a flow retardation region A at which a flow retardation phenomenon causing recirculation of the detergent water occurs is formed at the edge of the air bubble generator 103 adjacent to the nozzle 101, whereas fast flow speed corresponding to the flow speed of detergent water discharged from the nozzle 101 is maintained at the center of the air bubble generator 103.

At the flow retardation region A, the flow speed of the detergent water decreases, and the detergent water flows in whirls during the recirculation, with the result that the water and the detergent constituting the detergent water are stirred to improve a detergent dissolution degree.

At the center of the air bubble generator 103, pressure drop occurs due to rapid flow speed of the detergent water. That is, since the pressure at the center of the air bubble generator 103 is lower than that at the other section, external air is naturally introduced through the air suction hole 105 formed in the air bubble generator 103. Consequently, air bubbles are generated in the detergent water without an additional power unit to supply air.

The number of air bubbles generated is proportional to that of bubbles to be generated at the surface of the detergent water, and the air bubble unit 40 may generate a large number of bubbles.

Even when the air bubble generator 103 is gradually increased in section from the nozzle 101, the air bubble generator 103 may perform the same function to supply external air to the air bubble generator 103 through the air suction hole 105. To introduce much more external air into the air bubble generator 103, the air bubble generator 103 may be increased in section to have a step between the air bubble generator 103 and the nozzle 101.

The number of air bubbles generated by the air bubble unit 40 increases with the increase of air introduced through the air suction hole 105.

Consequently, it may be necessary to introduce a large amount of air into the air bubble generator 103 through the air suction hole 105. When an inner diameter B of the nozzle 101 is less than an inner diameter C of the nozzle guide 107, the flow speed of the detergent water passing through the air bubble generator 103 increases, with the result that the flow speed of air introduced through the air suction hole 105 increases, thereby increasing the amount of suctioned air.

Also, the amount of suctioned air increases with the increase of a diameter E of the air suction hole 105, thereby generating a large number of air bubbles. If the diameter of the air suction hole 105 is too large, air may not be suctioned. The air suction hole 105 may have a diameter E equivalent to not greater than 1.5 times an inner diameter D of the air bubble generator 103.

Also, the inner diameter D of the air bubble generator 103 may be less than the inner diameter C of the nozzle guide 107 to increase the flow speed in the air bubble generator 103 such that air is suctioned through the air suction hole 105.

The length of the air bubble unit 40 and the sizes of the nozzle guide 107, the nozzle 101, the air bubble generator 103, and the air suction hole 105 may be experimentally derived to generate bubbles having a size necessary for washing.

When the nozzle guide 107 has an inner diameter C of 20 to 27 mm, the nozzle 101 has an inner diameter B of 7 to 10 mm at one end thereof, the air bubble generator 103 has an inner diameter D of 11 to 15 mm, the air suction hole 105 has a diameter E of 4 to 15 mm, a distance F between the end of the nozzle 101 and the air suction hole 105 is 3 to 6 mm, and a distance G between the air suction hole 105 and one end of the air bubble generator 103 is 10 to 25 mm, a relatively large number of air bubbles may be generated. At this time, the air bubble unit may have a length of about 60 to 70 mm.

In this embodiment, the nozzle guide 107 has an inner diameter C of 24 mm, the nozzle 101 has an inner diameter B of 8 mm at one end thereof, the air bubble generator 103 has an inner diameter D of 13 mm, the air suction hole 105 has a diameter E of 8.6 mm, a distance F between the end of the nozzle 101 and the air suction hole 105 is 4 mm, and a distance G between the air suction hole 105 and one end of the air bubble generator 103 is 18 mm.

In a modified air bubble unit 40' as shown in FIG. 5, a passageway may include a nozzle guide 41' connected to the return hose 81, the nozzle guide having a substantially uniform inner diameter, a decreasing diameter part 43' extending from the nozzle guide 41' such that the decreasing diameter part 43' has a gradually decreasing diameter, a nozzle 45' extending from the decreasing diameter part 43', the nozzle 45' having a substantially uniform inner diameter, an increasing diameter part 47' extending from the nozzle 45' such that the increasing diameter part 47' has a gradually increasing diameter, and an air suction hole 49' communicating with the nozzle 45' to supply air to the nozzle 45'.

When detergent water passes through the air bubble unit 40', pressure drops at the nozzle 45', with the result that air is naturally introduced through the air suction hole 49'. That is, the decreasing diameter part 43' and the increasing diameter part 47' are configured in the form of a venturi tube having a contraction tube and an expansion tube, and the air suction hole 49 is located at the nozzle 45' having the lowest diameter. When detergent water passes through the air bubble unit 40', pressure drops at the nozzle 45' at which the flow speed increases, and external air is introduced through the air suction hole 49' by such pressure drop. The air is mixed with the detergent water, and air bubbles are naturally generated in the detergent water passing through the air bubble unit 40'.

The modified air bubble unit is different from the above-mentioned embodiment of the present invention in terms of the structure of the passageway. The fixing structure of the modified air bubble unit to the water tub may be the same as the above-mentioned embodiment of the present invention.

As shown in FIGS. 3 and 6, the air bubble unit 40 is directly connected to the introduction port 25 formed at the lower side of the front of the water tub 20.

To this end, the air bubble unit 40 is provided at opposite sides thereof with a pair of screw holes 111, through which screws are threadedly inserted to fix the air bubble unit 40 to the lower side of the front of the water tub 20.

The screw holes 111 are formed at opposite sides of the diffuser 109. The screw holes 111 are aligned with fastening holes 25*a* formed at opposite sides of the introduction port 25. Screws are threadedly inserted into the fastening holes 25*a* through the screw holes 111.

At the outer circumference of the air bubble unit 40 is provided a fixing guide 113 lengthily protruding in the longitudinal direction. When the air bubble unit 40 is fixed to the water tub 20, the fixing guide 113 comes into contact with the water tub 20 such that the air bubble unit 40 is supported at the water tub 20.

After the air bubble unit 40 is fixed to the water tub 20, the air bubble unit 40 may shake due to vibration of the water tub 20 or the movement of detergent water during the operation of the circulation pump 80. The horizontal movement of the air bubble unit 40 is prevented by a pair of screws located at the opposite sides of the air bubble unit 40. Also, the air bubble unit 40 is supported at the water tub 20 by the fixing guide 113, with the result that the vertical movement of the air bubble unit 40 is prevented. Consequently, the overall movement of the air bubble unit 40 is prevented.

As shown in FIGS. 1 and 3, the air bubble unit 40 is fixed to the lowermost end of the front of the water tub 20 to allow detergent water passing through the air bubble unit 40 to flow from the front to the rear of the lower side of the water tub 20 during the driving of the circulation pump 80.

After passing through the air bubble unit 40, the detergent water may flow in the horizontal direction adjacent to the bottom of the water tub 20 to accelerate dissolution of residual detergent gathering at the bottom of the water tub 20, not dissolved in the detergent water contained in the water tub 20.

The flow guide 26 extends from the introduction port 25 into the water tub 20 by a predetermined length to uniformly maintain the flow direction of the detergent water discharged from the air bubble unit 40.

The detergent water introduced into the introduction port 25 contains air bubbles. When detergent water containing air bubbles is introduced into the circulation pump 80 through the drainage port 27, the performance of the circulation pump may be lowered. The drainage port 27 may be spaced apart from the introduction port 25 by a predetermined distance such that the air bubbles contained in the detergent water introduced into the introduction port 25 do not move back to the circulation pump 80 through the drainage port 27. In this embodiment, the drainage port 27 is spaced apart from the introduction port 25 by a distance of about 140 mm to prevent the introduction of air bubbles through the drainage port 27, to which, however, embodiments of the present invention are not limited. The distance between the introduction port 25 and the drainage port 27 may be changed based on design specifications.

Also, a sealing member 42 is mounted between the air bubble unit 40 and the introduction port 25 to prevent the leakage of detergent water from a space between the air bubble unit 40 and the introduction port 25.

In this embodiment, the air bubble unit 40 is fixed to the lowermost end of the water tub 20. The air bubble unit 40 may be located within a height range at which air bubbles generated by the air bubble unit 40 are supplied to the detergent water contained in the water tub 20 to generate bubbles.

The air bubble unit 40 may be located between the bottom of the water tub 20 and the surface of detergent water.

If the air bubble unit 40 is located higher than the surface of the detergent water, it may be difficult to supply air bubbles generated by the air bubble unit 40 to the detergent water.

If the air bubble unit 40 is located lower than the bottom of the water tub 20, the number of generated air bubbles decreases. This is because as the pressure of detergent water increases with the increase in distance between the air bubble unit and the bottom of the water tub, it may be difficult to generate air bubbles.

When the air bubble unit 40 is located adjacent to the surface of detergent water, the pressure of the detergent water decreases to increase the number of air bubbles. In this embodiment, the air bubble unit 40 is mounted adjacent to the bottom of the water tub 20 for easy installation.

As long as the circulation pump has sufficient pumping pressure, a necessary number of air bubbles may be generated although the air bubble unit is spaced apart from the bottom of the water tub 20 in the direction of gravity.

The air bubble unit 40 is located at a position corresponding to the level of the detergent water in the water tub 20 to reduce the pressure in the air bubble unit 40 such that the detergent water smoothly passes through the air bubble unit 40. To improve assembly efficiency, on the other hand, the air bubble unit 40 may be coupled to the discharge port 93*a* of the second pump housing 93, and the air bubble unit 40 and the introduction port 25 may communicate with each other via the return hose 81.

Also, an air guide pipe 115 to guide external air to the air suction hole 105 is coupled to the air suction hole 105 of the air bubble unit 40 (See FIGS. 2 and 3).

One end of the air guide pipe 115 is connected to the air suction hole 105. The other end of the air guide pipe 115 may be located at any positions higher than the level of the detergent water contained in the water tub 20. In this embodiment, the other end of the air guide pipe 115 is fixed to one side of a diaphragm (not shown) of the water tub 20.

Since the other end of the air guide pipe 115 is located at a position higher than the level of the detergent water, the detergent water may be prevented from being discharged to the air suction hole 105, and bubbles in the water tub 20 may be prevented from instantaneously flowing backward and being discharged to the outside when the driving of the circulation pump 80 is stopped.

In the washing machine with the above-stated construction according to the embodiment of the present invention, bubbles are generated to wash laundry placed in the washing tub 30 using the bubbles. A bubble generation process will be described with reference to FIGS. 7 and 8.

Figure 7:
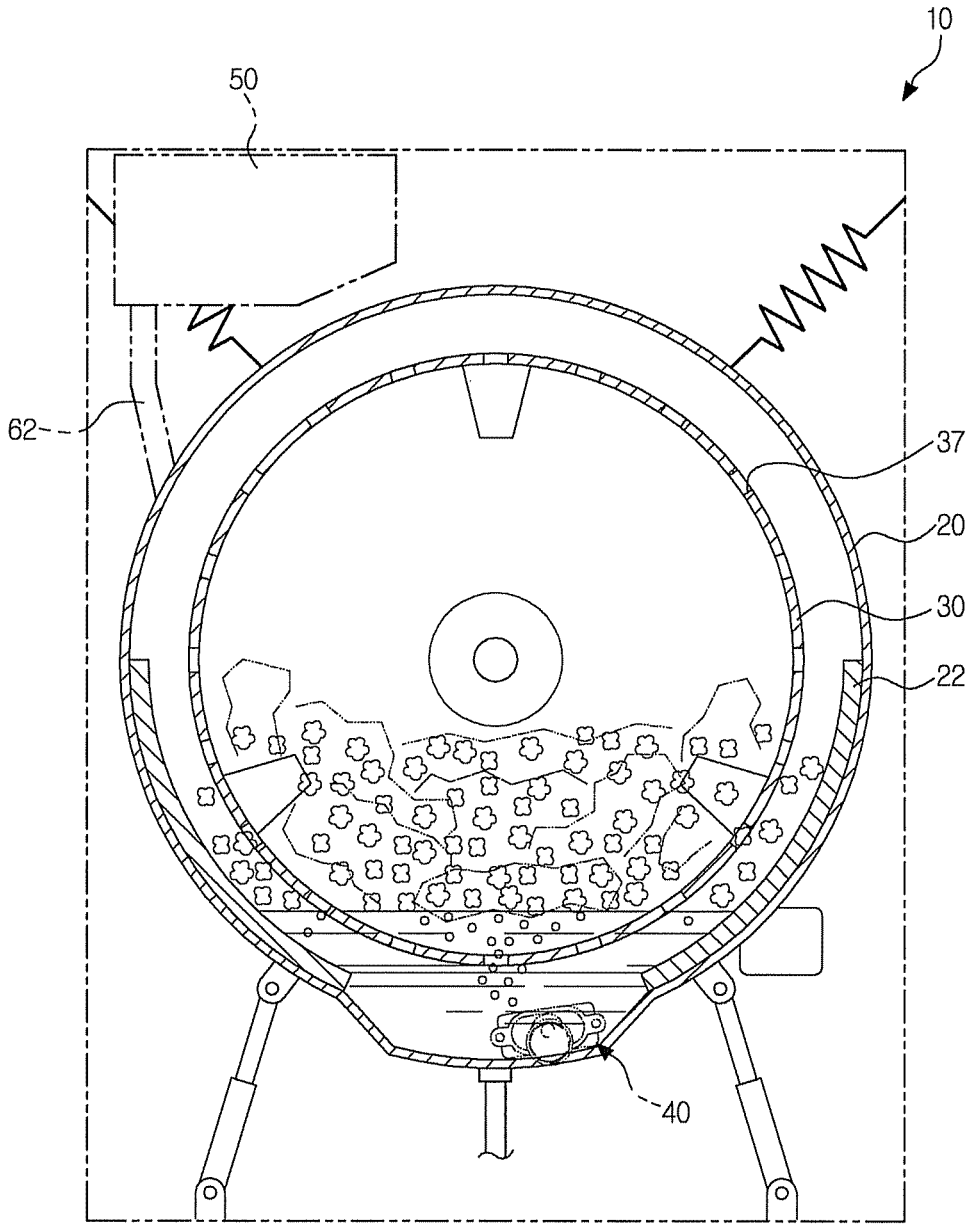
FIGS. 7 and 8 are views illustrating a bubble generation process in the washing machine according to the embodiment of the present invention.
Figure 8:
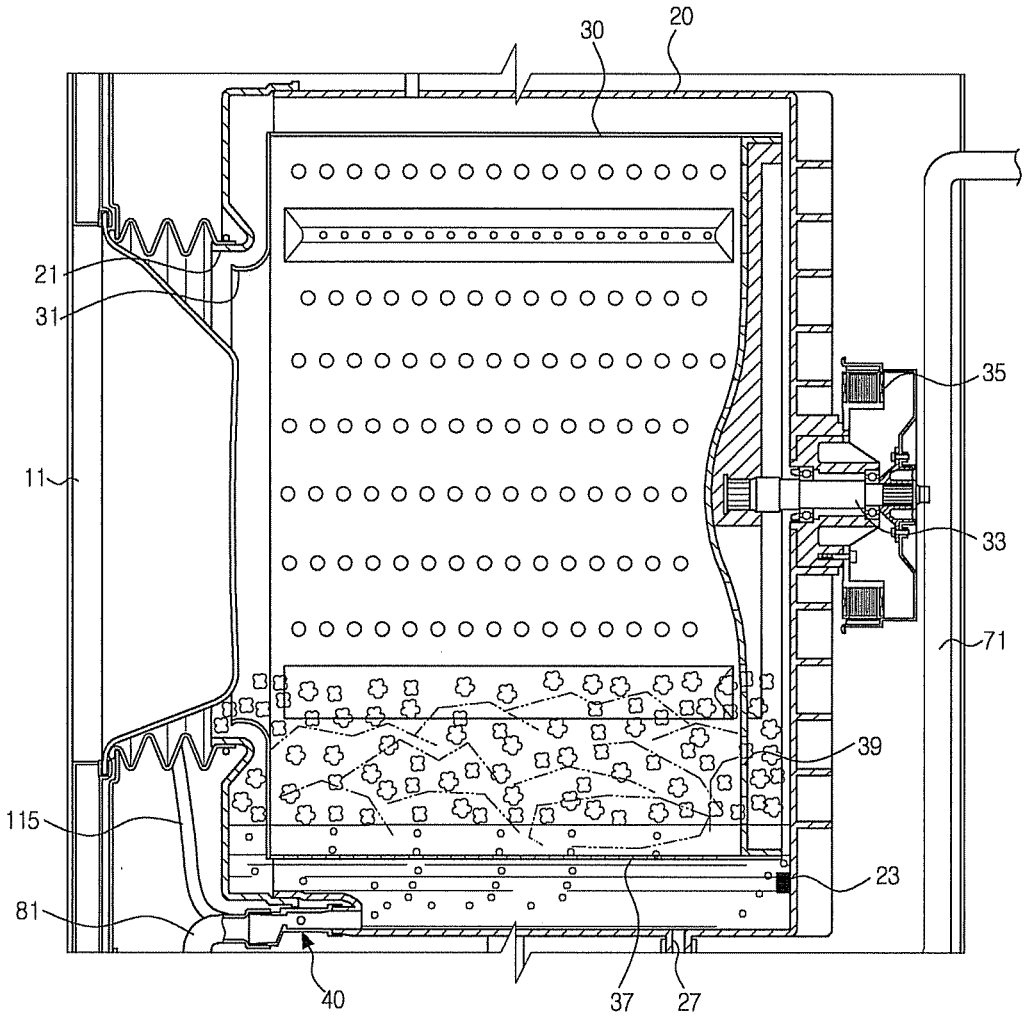

FIGS. 7 and 8 are views illustrating a bubble generation process in the washing machine according to the embodiment of the present invention.

Water, supplied through the water supply valve 63, is introduced into the lower part of the water tub 20 together with detergent via the detergent supply unit 50, with the result that detergent water (water+detergent) is supplied into a space between the water tub 20 and the washing tub 30. When the supplied detergent water reaches a bubble washing level, the supply of detergent water is stopped.

When the detergent water is supplied up to the bubble washing level, the circulation pump 80 is driven. The detergent water discharged from the circulation pump 80 is introduced into the air bubble unit 40 via the return hose 81. The detergent water containing air bubbles generated by the air bubble unit 40 is introduced into the space between the water tub 20 and the washing tub 30 through the introduction port 25.

The air bubbles introduced into the space between the water tub 20 and the washing tub 30 rise to the surface of the detergent water.

A large amount of detergent is gathered at the surface of the detergent water by surfactant of the detergent. When the air bubbles rise to the surface of the detergent water, bubbles are generated since surface tension of the detergent water is reduced by the surfactant of the detergent.

That is, the air bubbles rise to the surface of the detergent water at which a large amount of detergent gathers, thereby forming bubbles containing high-concentration detergent.

The bubbles grow at the surface of the detergent water between the water tub 20 and the washing tub 30 and at the surface of the detergent water in the washing tub 30. As shown in FIG. 8, the bubbles between the water tub 20 and the washing tub 30 are introduced into the washing tub 30 through the opening 31, the through-holes 37, and the rear through-holes 39 of the washing tub 30. After a predetermined time, a large number of bubbles are present in the washing tub 30.

The bubbles surround the laundry placed in the washing tub 30, and the high-concentration detergent contained in the bubbles is effectively absorbed into the laundry.

At this time, the bubbles formed between the water tub 20 and the washing tub 30 rises to a space between the inner circumference of the water tub 20 and the outer circumference of the washing tub 30 greater than the through-holes of the washing tub 30. As shown in FIG. 7, a pad 22 is provided at the inner circumference of the water tub 20 to smoothly introduce the rising bubbles into the washing tub 30.

The pad 22 is formed of rubber having a predetermined thickness to reduce the width between the water tub 20 and the washing tub 30. The pad 22 has a frictional force greater than the inner circumference of the water tub 20. Consequently, the pad 22 increases resistance during the growth of the bubbles, thereby restraining the rise of the bubbles in the space between the inner circumference of the water tub 20 and the outer circumference of the washing tub 30 such that the bubbles are introduced into the washing tub 30.

Also, the washing tub 30 may be rotated such that the bubbles between the water tub 20 and the washing tub 30 are smoothly introduced into the washing tub 30.

After a predetermined time for the bubbles to sufficiently wet the laundry placed in the washing tub 30 such that the high-concentration detergent is absorbed into the laundry, the washing tub 30 is rotated to wash the laundry using the bubbles.

Figure 9:
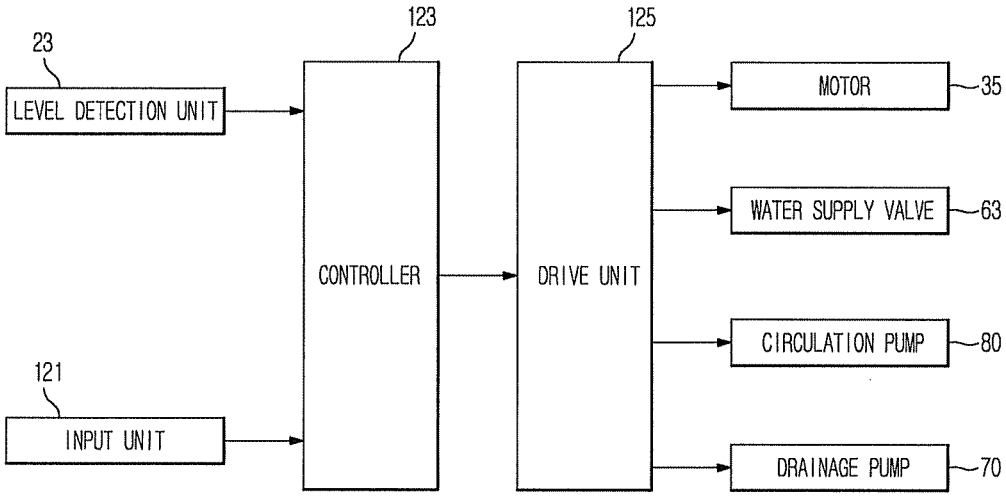
FIG. 9 is a control block diagram of the washing machine according to the embodiment of the present invention.

FIG. 9 is a control block diagram of the washing machine according to the embodiment of the present invention. The washing machine further includes an input unit 121, a controller 123, and a drive unit 125.

The input unit 121 inputs operation information, such as a washing course (for example, normal washing or bubble washing), spin-drying RPM, and additional rinsing, which are selected by a user, to the controller 123.

The controller 123 is a microprocessor to control the overall operations of the washing machine, such as washing, rinsing, and spin-drying, based on the operation information input from the input unit 121. The controller 123 stores motor RPM, motor operation rate (motor on-off time), and washing time set according to load (the weight of laundry) in the selected washing course.

For bubble washing, therefore, the controller 123 controls the motor RPM and the motor operation rate based on the load such that the motor 35 and the circulation pump 80 are driven to effectively perform the washing operation.

The drive unit 125 drives the motor 35, the water supply valve 63, the circulation pump 80, and the drainage pump 70 according to a drive control signal of the controller 123.

Hereinafter, the operation of the washing machine with the above-stated construction will be described.

When a user puts detergent into the detergent supply unit 50, puts laundry into the washing tub 30, and selects a bubble washing course, the operation information selected by the user is input to the controller 123 through the input unit 121. The controller 123 detects the load (the weight of the laundry) placed in the washing tub 30, and sets motor RPM, motor operation rate, and washing time based on the detected load.

The controller 123 controls the water supply valve 63 to supply water into the water tub 20 through the detergent supply unit 50 via the first water supply pipe 61. At this time, detergent in the detergent supply unit 50 is supplied into the water tub 20 via the second water supply pipe 62 together with the water. As a result, detergent water is supplied into the lower part of the water tub 20.

At this time, the level of the supplied detergent water is detected by the level detection unit 23. After the detergent water is supplied to a predetermined bubble washing level (about ¼ to ¾ of the level of detergent water in normal washing), the controller 123 controls the water supply valve 63 to be turned off such that the supply of water is stopped.

When the supply of the detergent water to the bubble washing level is completed, the controller 123 controls the circulation pump 80 to generate bubbles in the detergent water supplied into the lower part of the water tub 20 to perform a washing operation using the bubbles. A process of generating bubbles by the circulation pump 80 is the same as the above description.

The bubbles formed by combining the air bubbles with the detergent grow at the surface of the detergent water contained in the washing tub 30 and at the surface of the detergent water contained in the space between the water tub 20 and the washing tub 30. The bubbles growing in the space between the water tub 20 and the washing tub 30 are introduced into the washing tub 30 through the opening 31, the through-holes 37, and the rear through-holes 39 of the washing tub 30, and start to rise in the washing tub 30 together with the bubbles growing in the washing tub 30. After a predetermined time (about three minutes), the bubbles are dispersed in the washing tub 30, and stick to the laundry to transmit high-concentration detergent to the laundry.

When it is determined that a number of bubbles sufficient to perform bubble washing are present in the washing tub 30, the controller 123 controls the washing tub 30 to be rotated at the motor RPM and operation rate set to perform a washing operation using bubbles to perform a bubble washing operation.

Consequently, the bubbles containing the high-concentration detergent surround the laundry, such that the detergent is effectively absorbed into the laundry, thereby improving washing efficiency.

Also, the bubbles may act as a cushion with respect to dropping of the laundry and friction between laundry articles by rotation of the washing tub 30, thereby preventing the laundry from being damaged due to the friction between the laundry articles.

Also, the bubble washing may not use water necessary for the laundry to be soaked in the detergent water as in the conventional art, thereby reducing water consumption.

In this embodiment, the circulation pump 80 and drainage pump 70 are mounted at the pump casing 90 in a symmetrical fashion, to which, however, embodiments of the present invention are not limited. For example, the circulation pump 80 and drainage pump 70 may be mounted side by side at the lower front of the machine housing 10. Also, the circulation pump 80 and drainage pump 70 may be applied to any structures to circulate and drain water.

Also, in this embodiment, the detergent water is supplied up to a predetermined level in the washing tub such that bubbles stick to the laundry while at least some of the laundry is wetted to perform bubble washing, to which, however, embodiments of the present invention are not limited. For example, bubbles may be generated while the detergent water is supplied only into the space between the water tub and the washing tub to perform washing using only the bubbles.

Also, in this embodiment, the water tub 20 is installed parallel to an installation plane of the washing machine, to which, however, embodiments of the present invention are not limited. For example, the water tub 20 may be installed at a predetermined angle to the installation plane of the washing machine.

As is apparent from the above description, bubbles containing high-concentration detergent may surround laundry, such that the detergent is effectively absorbed into the laundry, thereby improving washing efficiency.

Also, the bubbles may act as a cushion with respect to dropping of the laundry and friction between laundry articles by rotation of the washing tub, thereby preventing the laundry from being damaged due to the friction.

Also, the bubble washing may not use water necessary for the laundry to be soaked in the detergent water as in the conventional art, thereby reducing water consumption.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

an air bubble unit to generate air bubbles in detergent water using external air naturally introduced thereinto by pressure difference caused when the detergent water passes therethrough;

a water tub having an introduction port to allow the detergent water containing the air bubbles to be introduced thereinto; and a washing tub rotatably provided in the water tub, the washing tub having a plurality of through-holes having a size less than the introduction port such that the air bubbles rise to a surface of the detergent water contained in the water tub, wherein the air bubble unit comprises:

a nozzle;

an air bubble generator extending from the nozzle, a step being formed between the nozzle and the air bubble generator such that the air bubble generator has an increasing inner diameter; and an air suction hole provided at the air bubble generator to guide external air to the air bubble generator, wherein the air bubble unit is disposed outside of the water tub, and wherein the air bubble generator is connected to the water tub without having a portion bent between the air bubble generator and the introduction port of the water tub to enhance a supply of air bubbles toward the water tub.

2. The washing machine according to claim 1, wherein:

the nozzle has a gradually decreasing inner diameter; and the air bubble generator has an increasing inner diameter.

3. The washing machine according to claim 2, wherein the inner diameter of the air bubble generator suddenly increases at the nozzle.

4. The washing machine according to claim 1, wherein the air bubble unit further comprises a nozzle guide extending to an inlet of the nozzle to guide detergent water to the nozzle, and the nozzle guide has an inner diameter greater than the air bubble generator.

5. The washing machine according to claim 1, wherein the air bubble unit has a length of about 60 to about 70 mm.

6. The washing machine according to claim 1, wherein the air bubble unit further comprises a diffuser extending from the air bubble generator, the diffuser having a gradually increasing diameter.

7. The washing machine according to claim 1, wherein the air bubble generator allows the air introduced through the air suction hole to be turbulently mixed with the detergent water.

8. The washing machine according to claim 4, wherein the nozzle guide has an inner diameter of about 20 to about 27 mm.

9. The washing machine according to claim 1, wherein the air bubble generator has an inner diameter of about 11 to about 15 mm.

10. The washing machine according to claim 1, wherein the air suction hole has a diameter of about 4 to about 15 mm.

11. The washing machine according to claim 1, further comprising an air guide pipe having one end communicating with the air suction hole and the other end located at a position higher than a level of the detergent water in the water tub to prevent the detergent in the water tub from being discharged to the air suction hole.

12. The washing machine according to claim 4, wherein the inner diameter of the nozzle guide is at least two times greater than the nozzle.

13. The washing machine according to claim 1, wherein the air bubble unit is configured to supply air bubbles to the water tub such that, when the air bubbles rise to an interior of the washing tub through the through-holes of the washing tub, the air bubbles increase in size as they travel up to the surface of the detergent water, resulting in bubbles ranging in size between about 3 mm and about 15 mm at or near the surface of the detergent water.

14. The washing machine according to claim 1, wherein the air suction hole is located within about 6 mm from an air suction hole-side end of the nozzle.

15. The washing machine according to claim 1, further comprising a drainage port formed at a bottom of the water tub and a circulation pump to discharge the detergent water from the water tub to the drainage port to forcibly move the detergent water to the air bubble unit.

16. The washing machine according to claim 15, wherein the drainage port is spaced apart from the introduction port by a predetermined distance such that air bubbles introduced from the introduction port are not discharged to the drainage port.

17. The washing machine according to claim 15, wherein the drainage port is spaced apart from the introduction port by about 140 mm.

18. The washing machine according to claim 15, further comprising a return hose to guide water from the circulation pump to the air bubble unit.

19. The washing machine according to claim 1, wherein the air bubble unit is directly connected to a lower side of the water tub.

20. The washing machine according to claim 1, wherein the introduction port is opened such that the detergent water containing the air bubbles is introduced in substantially the same direction as an installation plane of a machine housing to join the detergent in the washing tub.

21. The washing machine according to claim 19, wherein the introduction port is located at a front of the water tub adjacent to a bottom of the water tub, and the introduction port comprises a passageway, having a predetermined length, to guide a flow direction of the detergent water containing the air bubbles.

22. The washing machine according to claim 19, wherein the air bubble unit is directly connected to the introduction port substantially in parallel to an axial direction of the water tub.

23. The washing machine according to claim 19, further comprising a sealing member provided between the air bubble unit and the introduction port to prevent leakage of detergent water.

24. The washing machine according to claim 19, wherein the air bubble unit is coupled to the water tub by screws, and the washing machine further comprises a fixing guide supported at the water tub to prevent the air bubble unit from vibrating.

25. The washing machine according to claim 1, further comprising a pad provided at the water tub to smoothly introduce bubbles formed between an inner circumference of the water tub and an outer circumference of the washing tub into the washing tub.

26. The washing machine according to claim 25, wherein the pad is formed of rubber, and is attached to the inner circumference of the water tub.

27. The washing machine according to claim 1, wherein the washing tub comprises a plurality of through-holes provided at a circumference thereof and a plurality of rear through-holes provided at a rear thereof, and bubbles formed between the water tub and the washing tub are introduced into the washing tub through the through-holes and the rear through-holes.

28. The washing machine according to claim 27, wherein the rear through-holes have a diameter greater than the through-holes but less than the introduction port.

29. The washing machine according to claim 15, further comprising a drainage pump to drain the detergent water from the water tub to an outside, and a pump housing having the circulation pump and the drainage pump mounted therein is configured in one unified body.

30. The washing machine according to claim 1, wherein the washing machine comprises a front door and the washing tub receives laundry through the front door.

31. A washing machine comprising:

a water tub having an introduction port to allow detergent water containing the air bubbles to be introduced therein;

a washing tub rotatably provided in the water tub to receive laundry;

a water supply unit to supply water mixed with detergent to a level for the laundry placed in the washing tub not to be soaked or to be partially soaked, to make detergent water; and an air bubble unit to generate air bubbles in the water, wherein the air bubbles generated by the air bubble unit are converted into bubbles for washing, and the bubbles are supplied to a portion of the laundry not soaked in the detergent water, wherein the air bubble unit comprises:

a nozzle;

an air bubble generator extending from the nozzle, a step being formed between the nozzle and the air bubble generator such that the air bubble generator has an increasing inner diameter; and an air suction hole provided at the air bubble generator to guide external air to the air bubble generator, wherein the air bubble unit is disposed outside of the water tub, and wherein the air bubble generator is connected to the water tub without having a portion bent between the air bubble generator and the introduction port of the water tub to enhance a supply of air bubbles toward the water tub.

* * * * *